US010504447B2

(12) United States Patent
Lan et al.

(10) Patent No.: US 10,504,447 B2
(45) Date of Patent: Dec. 10, 2019

(54) GOA UNIT AND DRIVING METHOD THEREOF, GOA CIRCUIT, DISPLAY DEVICE

(71) Applicants: BOE TECHNOLOGY GROUP CO., LTD., Beijing (CN); CHENGDU BOE OPTOELECTRONICS TECHNOLOGY CO., LTD., Chengdu, Sichuan Province (CN)

(72) Inventors: Chuanyan Lan, Beijing (CN); Taehyun Kim, Beijing (CN)

(73) Assignees: BOE TECHNOLOGY GROUP CO., LTD., Beijing (CN); CHENGDU BOE OPTOELECTRONICS TECHNOLOGY CO., LTD., Chengdu, Sichuan Province (CN)

( * ) Notice: Subject to any disclaimer, the term of this patent is extended or adjusted under 35 U.S.C. 154(b) by 0 days.

(21) Appl. No.: 15/769,058

(22) PCT Filed: Sep. 20, 2017

(86) PCT No.: PCT/CN2017/102508
§ 371 (c)(1),
(2) Date: Apr. 17, 2018

(87) PCT Pub. No.: WO2018/171137
PCT Pub. Date: Sep. 27, 2018

(65) Prior Publication Data

US 2019/0066597 A1 Feb. 28, 2019

(30) Foreign Application Priority Data

Mar. 20, 2017 (CN) ..... 2017 1 0167240

(51) Int. Cl.
*G09G 3/3266* (2016.01)
*G09G 3/3233* (2016.01)

(52) U.S. Cl.
CPC ..... *G09G 3/3266* (2013.01); *G09G 3/3233* (2013.01); *G09G 2300/0408* (2013.01);
(Continued)

(58) Field of Classification Search
CPC ..... G09G 3/3266; G09G 3/3233; G09G 2300/0408; G09G 2310/08; G09G 2320/0247; G09G 2330/026
See application file for complete search history.

(56) References Cited

U.S. PATENT DOCUMENTS 8,482,492 B2 7/2013 Kim et al.
2010/0013824 A1* 1/2010 Kim ..... G09G 3/3266 345/214
(Continued)

FOREIGN PATENT DOCUMENTS

CN 102542983 A 7/2012
CN 105185304 A 12/2015
(Continued)

OTHER PUBLICATIONS

International Search Report and Written Opinion issued in International Application No. PCT/CN2017/102508 dated Dec. 27, 2017 (with English translation).
(Continued)

*Primary Examiner* — Robert J Michaud
(74) *Attorney, Agent, or Firm* — McDermott Will & Emery LLP

(57) ABSTRACT

The present disclosure provides a GOA unit of a light emitting control signal and its driving method, a GOA circuit and display device, relating to the field of display technology. And they can overcome the problems of a screen flickering or an abnormal display that the display device may have. The GOA unit of the light emitting control signal includes a potential control module, a pull-down module, a
(Continued)

pull-up module and a writing module. The writing module is connected to a second voltage terminal, a signal control terminal, a signal output terminal, and outputs the voltage of the second voltage terminal to the signal output terminal.

10 Claims, 8 Drawing Sheets

(52) U.S. Cl.
CPC . *G09G 2310/08* (2013.01); *G09G 2320/0247* (2013.01); *G09G 2330/026* (2013.01)

(56) References Cited

U.S. PATENT DOCUMENTS

| | | | | |
|---|---|---|---|---|
| 2012/0161637 | A1 | 6/2012 | Lee et al. | |
| 2015/0279288 | A1* | 10/2015 | Dai | G02F 1/13306 345/690 |
| 2017/0069264 | A1 | 3/2017 | Dai et al. | |
| 2017/0193927 | A1* | 7/2017 | Yang | G09G 3/3426 |

FOREIGN PATENT DOCUMENTS

| | | | |
|---|---|---|---|
| CN | 105609058 | A | 5/2016 |
| CN | 106297697 | A | 1/2017 |
| CN | 106652918 | A | 5/2017 |

OTHER PUBLICATIONS

First Office Action issued in related Chinese Application No. 201710167240.4 dated Jan. 17, 2018 (with English translation).

* cited by examiner

GOA UNIT AND DRIVING METHOD THEREOF, GOA CIRCUIT, DISPLAY DEVICE

CROSS-REFERENCE TO RELATED APPLICATION

This application is the U.S. National Phase under 35 U.S.C. § 371 of International Patent Application No. PCT/CN2017/102508, filed on Sep. 20, 2017, which in turn claims priority to Chinese Patent Application No. 201710167240.4, filed on Mar. 20, 2017, titled "GOA UNIT AND DRIVING METHOD THEREOF, GOA CIRCUIT, DISPLAY DEVICE", the entire disclosures of which Applications are incorporated by reference herein.

TECHNICAL FIELD

The present disclosure relates to the display technology field, more particularly, to a GOA unit of a light emitting control signal and the driving method thereof, GOA circuit, and display device.

BACKGROUND

Organic light emitting diode (OLED) display is one of the recent popular research focuses. As compared to Liquid Crystal Display (LCD), OLED display has advantages of low energy consumption, low manufacturing cost, being self-luminous, wide viewing angle and quick response and so on.

In the existing display devices, each row of pixel units is connected with a scanning signal line and a light emitting control signal line. In the prior art, in order to narrow the frame of a display, the GOA unit of a scanning signal is usually adopted to drive the scanning signal line, and the GOA unit of a light emitting control signal is used to drive the light emitting control signal line. A GOA circuit is usually formed by a plurality of cascaded GOA units. At the time of booting or waking up the sleep mode, as illustrated by FIG. 1(*a*) and FIG. 1(*b*), before each cascaded GOA unit driving the corresponding pixel circuit as shown in FIG. 1(*a*), the driving transistor Md in the pixel circuit is in the floating state. At this moment, the driving transistor Md is prone to the disturbance of other signals, so that some driving transistors Md in the pixel circuit are turned on. In this case, a current flows through the lines of the transistors Md and M6, resulting in the pixel turned on by the driving transistor Md giving out incorrect light by mistake.

Moreover, as the signal of the high voltage terminal VDD is input earlier than that of the low voltage terminal VSS, and there is a current in the lines of the transistors Md and M6 within the pixel circuit turned on by the driving transistor Md, the magnitude of voltage at the low voltage terminal VSS will be raised, damaging or destroying the power sources that supply signals to the high voltage terminal VDD/low voltage terminal VSS. Under this circumstance, the SSD (start-up short detection function) of the circuit will initiate the function of protection, cut off the power source automatically, and this will cause the screen is failure to display normally.

SUMMARY

Embodiments of this application adopt the following technical solutions:

At first aspect, a GOA unit of a light emitting control signal is provided. The GOA unit comprises a potential control module, a pull-up module, a pull-down module and a writing module; the potential control module is connected to the first voltage terminal, the second voltage terminal, the first clock signal terminal, the second clock signal terminal, signal input terminal and the first node, respectively; and the potential control module is configured to output the signal of the second voltage terminal to the first node under the control of the first clock signal terminal and the first voltage terminal; and/or, to output the signal of the second clock signal terminal to the first node under the control of the first clock signal terminal, the first voltage terminal and the signal input terminal. The pull-down module is connected to the first node, the first voltage terminal, the second voltage terminal, the first clock signal terminal, the second clock signal terminal and a signal output terminal, respectively; and the pull-down module is configured to output the signal of the first voltage terminal to the signal output terminal under the control of the first node, the first voltage terminal, the second voltage terminal, the first clock signal terminal, and the second clock signal terminal. The pull-up module is connected to the first node, the second voltage terminal and signal output terminal, respectively; and the pull-up module is configured to output the signal of the second voltage terminal to the signal output terminal under the control of the first node. The writing module is connected to the second voltage terminal, a signal control terminal and the signal output terminal, respectively; and the writing module is configured to output the voltage of the second voltage terminal to the signal output terminal under the control of the signal control terminal.

Optionally, the writing module comprises a first transistor; a gate of the first transistor is connected to the signal control terminal, a first electrode of the first transistor is connected to the second voltage terminal, and a second electrode of the first transistor is connected to the signal output terminal.

Optionally, the potential control module comprises a pull-up control module and a pull-down control module. The pull-up control module is connected to the pull-down control module, the first clock signal terminal, the first voltage terminal, the second voltage terminal and the first node, respectively; and the pull-up control module is configured to output the signal of the second voltage terminal to the first node under the control of the first clock signal terminal and the first voltage terminal. The pull-down control module is connected to the signal input terminal, the first clock signal terminal, the second clock signal terminal, the first voltage terminal and the first node, respectively; and the pull-down control module is configured to output the signal of the second clock signal terminal to the first node under the control of the signal input terminal, the first clock signal terminal and the first voltage terminal.

Optionally, the pull-up control module further comprises a second transistor, a third transistor and a first capacitor. A gate of the second transistor is connected to the first clock signal terminal, a first electrode of the second transistor is connected to the first voltage terminal, and a second electrode of the second transistor is connected to a gate of the third transistor. A first electrode of the third transistor is connected to the second voltage terminal, and a second electrode of the third transistor is connected to the first node. A first end of the first capacitor is connected to the second voltage terminal, and a second end of the first capacitor is connected to the gate of the third transistor.

Further optionally, the pull-up control module is further connected to the second clock signal terminal, and the pull-up control module further comprises a fourth transistor and a fifth transistor. A gate of the fourth transistor is connected to the second electrode of the second transistor, a first electrode of the fourth transistor is connected to the second voltage terminal, and a second electrode of the fourth transistor is connected to a first electrode of the fifth transistor. A gate of the fifth transistor is connected to the second clock signal terminal, and a second electrode of the fifth transistor is connected to the pull-down control module.

Optionally, the pull-down control module comprises the sixth transistor, the seventh transistor, the eighth transistor and the second capacitor. A gate of the sixth transistor is connected to the first clock signal terminal, a first electrode of the sixth transistor is connected to the signal input terminal, and a second electrode of the sixth transistor is connected to a first electrode of the seventh transistor. A gate of the seventh transistor is connected to the first voltage terminal, and a second electrode of the seventh transistor is connected to a gate of the eighth transistor. A first electrode of the eighth transistor is connected to the second clock signal terminal, and a second electrode of the eighth transistor is connected to the first node. A first end of the second capacitor is connected to the gate of the eighth transistor, and a second end of the second capacitor is connected to the second electrode of the eighth transistor.

Further optionally, the pull-down control module further comprises a ninth transistor. A gate of the ninth transistor is connected to the second electrode of the sixth transistor, a first electrode of the ninth transistor is connected to the first clock signal terminal, and a second electrode of the ninth transistor is connected to the pull-up control module.

Optionally, the pull-down module comprises of a tenth transistor, an eleventh transistor, a twelfth transistor and a third capacitor. A gate of the tenth transistor is connected to the first clock signal terminal, a first electrode of the tenth transistor is connected to the first voltage terminal, and a second electrode of the tenth transistor is connected to a gate of the twelfth transistor. A gate of the eleventh transistor is connected to the first node, a first electrode of the eleventh transistor is connected to the second voltage terminal, and a second electrode of the eleventh transistor is connected to the gate of the twelfth transistor. A first electrode of the twelfth transistor is connected to the first voltage terminal, and a second electrode of the twelfth transistor is connected to the signal output terminal. A first end of the third capacitor is connected to the second clock signal terminal, and a second end of the third capacitor is connected to the gate of the twelfth transistor.

Optionally, the pull-up module comprises a thirteenth transistor. A gate of the thirteenth transistor is connected to the first node, a first electrode of the thirteenth transistor is connected to the second voltage terminal, and a second electrode of the thirteenth transistor is connected to the signal output terminal.

At second aspect, a driving method of a GOA unit of the light emitting control signal according to the first aspect, comprising: within the first N image frames, the writing module writes the signal of the second voltage terminal to the signal output terminal under the control of the signal control terminal; from the image frame N+1, at the buffer stage of an image frame, the first clock signal terminal is input with a first voltage, the signal input terminal is input with the first voltage, the second clock signal terminal is input with a second voltage, and the potential control module outputs the signal of the second voltage terminal to the first node under the control of the first voltage terminal and the first voltage input to the first clock signal terminal, and outputs the second voltage input to the second clock signal terminal to the first node under the control of the first voltage input to the first clock signal terminal, the first voltage terminal and the first voltage input to the signal input terminal; the pull-down module outputs the signal from the first voltage terminal to the signal output terminal under the control of the first node, the first voltage terminal, the second voltage terminal, the first voltage input to the first clock signal terminal and the second voltage input to the second clock signal terminal; at the pull-up stage of an image frame, the second clock signal terminal is input with the first voltage, the first clock signal terminal is input with the second voltage, the signal input terminal is input with the second voltage, and the potential control module outputs the first voltage input to the second clock signal terminal to the first node under the control of the second voltage input to the first clock signal terminal, the first voltage terminal, and the second voltage input to the signal input terminal; the pull-up module outputs the signal of the second voltage terminal to the signal output terminal under the control of the first node; at the pull-down stage of an image frame, the first clock signal terminal is input with the first voltage, the second clock signal terminal is input with the second voltage, the signal input terminal is input with the second voltage, and the potential control module outputs the signal of the second voltage terminal to the first node under the control of the first voltage terminal and the first voltage input to the first clock signal terminal; the pull-down module outputs the signal of the first voltage terminal to the signal output terminal under the control of the first node, the first voltage terminal, the second voltage terminal, the first voltage input to the first clock signal and the second voltage input to the second clock signal terminal; wherein, N is a positive integer greater than or equal to 1.

At third aspect, a GOA circuit is provided. The GOA circuit comprises multiple cascaded GOA units of the light emitting control signal according to the first aspect.

At fourth aspect, a display device is provided. The display device comprises the GOA circuit according to the third aspect.

BRIEF DESCRIPTION OF THE DRAWINGS

In order to describe technical solutions in embodiments of the present disclosure or in the prior art more clearly, the accompanying drawings to be used in the description of embodiments or the prior art will be introduced briefly. Obviously, the accompanying drawings to be described below are merely some embodiments of the present disclosure, and a person of ordinary skill in the art can obtain other drawings according to those drawings without paying any creative effort.

FIG. 1(*b*) is a sequence diagram of all signals adopted for driving the pixel circuit illustrated by FIG. 1(*a*);

DETAILED DESCRIPTION

The technical solutions in the embodiments of the present disclosure will be described clearly and completely with reference to the accompanying drawings in the embodiments of the present disclosure. Obviously, the described embodiments are merely some but not all of embodiments of the present disclosure. All other embodiments made on the basis of the embodiments of the present disclosure by a person of ordinary skill in the art without paying any creative effort shall be included in the protection scope of the present disclosure.

Figure 2:
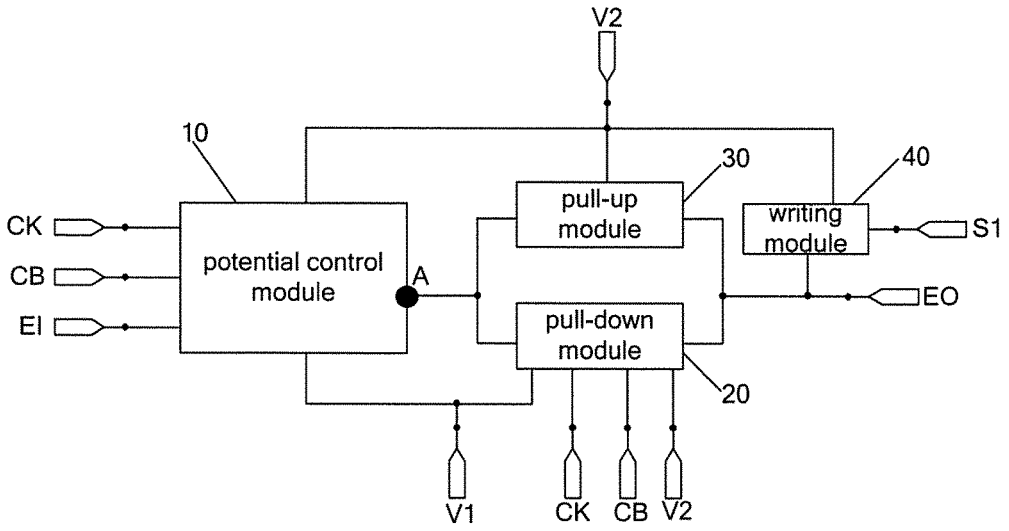
FIG. 2 is a first schematic diagram of a GOA unit provided by the embodiments of the present disclosure.

Some embodiments of the present disclosure provide a GOA unit of the light emitting control signal. As illustrated by FIG. 2, the GOA unit comprises a potential control module 10, a pull-down module 20, a pull-up module 30 and a writing module 40.

In detail, the potential control module 10 is connected to a first voltage terminal V1, a second voltage terminal V2, a first clock signal terminal CK, a second clock signal terminal CB, a signal input terminal EI, and a first node A, respectively. The potential control module 10 is configured to output the signal of the second voltage terminal V2 to the first node A under the control of the first clock signal terminal CK and the first voltage terminal V1; and/or, to output the signal of the second clock terminal CB to the first node A under the control of the signal input terminal EI.

The pull-down module 20 is connected to the first node A, the first voltage terminal V1, the second voltage terminal V2, the first clock signal terminal CK, the second clock signal terminal CB and a signal output terminal EO, respectively. The pull-down module 20 is configured to output the signal of the first voltage terminal V1 to the signal output terminal EO under the control of the first node A, the first voltage terminal V1, the second voltage terminal V2, the first clock signal terminal CK and the second clock signal terminal CB.

The pull-up module 30 is connected to the first node A, the second voltage terminal V2 and the signal output terminal EO, respectively. The pull-up module 30 is configured to output the signal of the second voltage terminal V2 to the signal output terminal EO under the control of the first node A.

The writing module 40 is connected to the second voltage terminal V2, a signal control terminal S1 and the signal output terminal EO, respectively. The writing module 40 is configured to output the voltage of the second voltage terminal V2 to the signal output terminal EO under the control of the signal control terminal S1.

As for the GOA unit of the light emitting control signal provided by some embodiments of the present disclosure, a writing module 40 is added in the GOA unit and is turned on in the first N image frames at the same time of other modules being turned off, and the signal of the second voltage terminal V2 is output to the signal output terminal EO and the light emitting control transistor in the pixel circuit connected to the signal output terminal EO is controlled to be turned off through the signal output terminal EO. Thus, there is no current flowing to the light emitting component in the pixel circuit no matter the driving transistor is turned on or turned off. And therefore, there will be no incorrect light emitting phenomenon by mistake, and the SSD in the circuit will not cut off the power source. Once the circuit is stabilized, the writing module 40 in the GOA unit is controlled to be turned off, and other modules are controlled to be turned on normally, and then the pixel circuit is controlled to display normally. Therefore, the image quality of the display device can be guaranteed.

Figure 3:
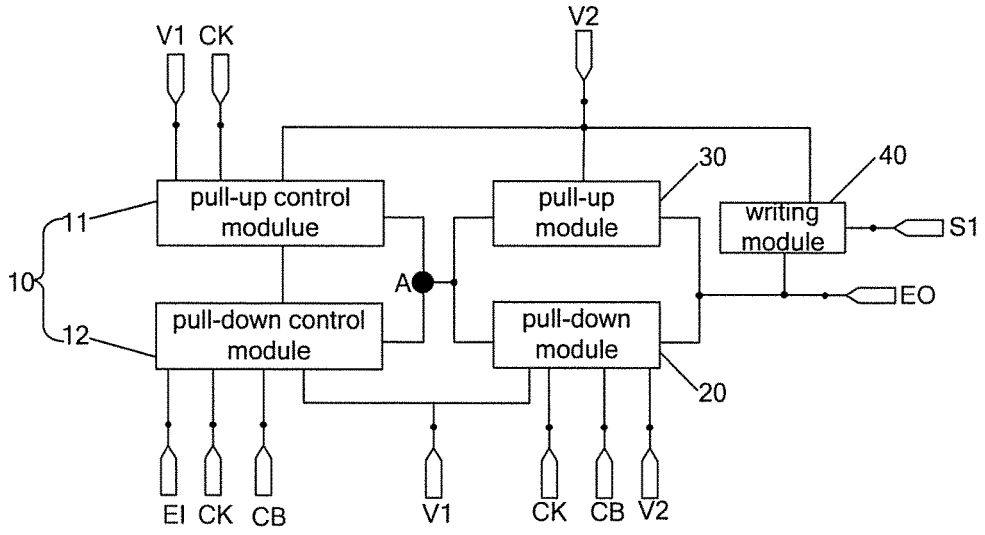
FIG. 3 is a second schematic diagram of a GOA unit provided by the embodiments of the present disclosure.

Optionally, as illustrated by FIG. 3, the potential control module 10 comprises a pull-up control module 11 and a pull-down control module 12.

The pull-up control module 11 is connected to the pull-down control module 12, the first clock signal terminal CK, the first voltage terminal V1, the second voltage terminal V2 and the first node A, respectively. The pull-up control module 11 is configured to output the signal of the second voltage terminal V2 to the first node A under the control of the first clock signal terminal CK and the first voltage terminal V1.

The pull-down control module 12 is further connected to the signal input terminal EI, the first clock signal terminal CK, the second clock signal terminal CB, the first voltage terminal V1 and the first node A, respectively. The pull-down control module 12 is configured to output the signal of the second clock signal terminal CB to the first node A under the control of the signal input terminal EI, the first clock signal terminal CK and the first voltage terminal V1.

The detailed structure of each module in the GOA unit of the light emitting control signal as illustrated in FIG. 3 is described below in detail.

Figure 4:
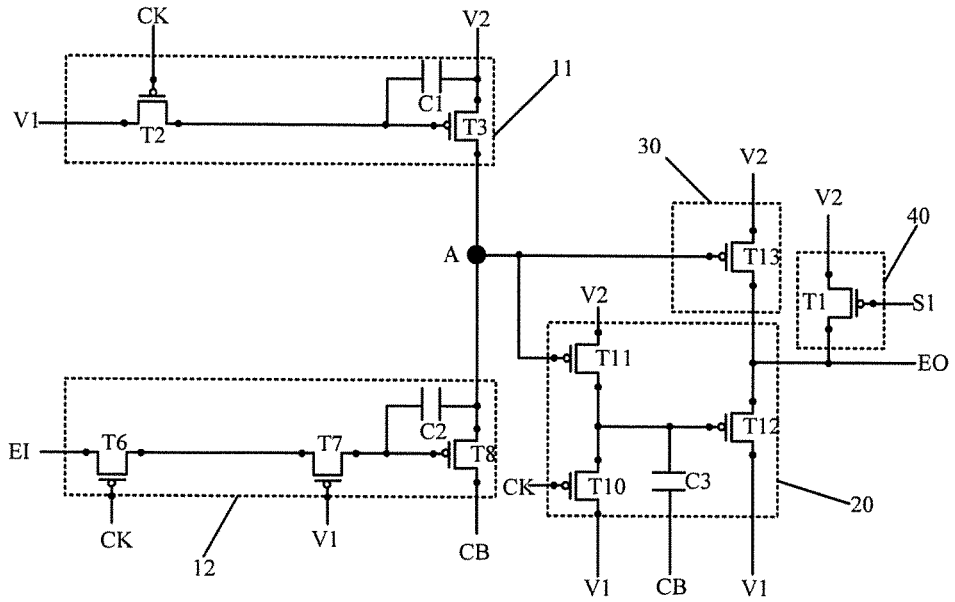
FIG. 4 is a first detailed schematic diagram of all modules of the GOA unit as shown in FIG. 3.

In particular, as illustrated by FIG. 4, the writing module 40 comprises a first transistor T1.

A gate of the first transistor T1 is connected to the signal control terminal S1, a first electrode of the first transistor T1 is connected to the second voltage terminal V2, and the second electrode of the first transistor T1 is connected to the signal output terminal EO.

It should be noted that the writing module 40 may further comprise multiple transistors T1 connected in parallel. The above are only examples of the writing module 40, and other structures of the same function as the writing module 40 are all within the protection scope of the present disclosure and are not elaborated herein.

As illustrated in FIG. 4, the pull-up control module 11 comprises a second transistor T2, a third transistor T3 and a first capacitor C1.

A gate of the second transistor T2 is connected to the first clock signal terminal CK, a first electrode of the second transistor T2 is connected to the first voltage terminal V1, and a second electrode of the second transistor T2 is connected to a gate of the third transistor T3.

A first electrode of the third transistor T3 is connected to the second voltage terminal V2, and a second electrode of the third transistor T3 is connected to the first node A.

A first end of the first capacitor C1 is connected to the second voltage terminal V2, and a second end is connected to the gate of the third transistor T3.

It should be noted that the pull-up control module 11 may further comprise multiple switching transistors connected in parallel with the second transistor T2, and/or multiple switching transistors connected in parallel with the third transistor T3. The above are only examples of the pull-up control module 11, and other structures of the same function as the pull-up control module 11 are all within the protection scope of the present disclosure and are not elaborated here.

As illustrated in FIG. 4, the pull-down control module 12 comprises a sixth transistor T6, a seventh transistor T7, a eighth transistor T8 and a second capacitor C2.

A gate of the sixth transistor T6 is connected to the first clock signal terminal CK, a first electrode of the sixth transistor T6 is connected to the signal input terminal EI, and a second electrode of the sixth transistor T6 is connected to a first electrode of the seventh transistor T7.

A gate of the seventh transistor T7 is connected to the first voltage terminal V1, and a second electrode of the seventh transistor T7 is connected to a gate of the eighth transistor T8.

A first electrode of the eighth transistor T8 is connected to the second clock signal terminal CB, and a second electrode of the eighth transistor T8 is connected to the first node A.

A first end of the second capacitor C2 is connected to the gate of the eighth transistor T8, and a second end of the second capacitor C2 is connected to the second electrode of the eighth transistor T8.

It should be noted that the pull-down control module 12 may further comprise multiple switching transistors connected in parallel with the sixth transistor T6, and/or multiple switching transistors connected in parallel with the seventh transistor T7, and/or multiple switching transistors connected in parallel with the eighth transistor T8. The above are only examples of the pull-down control module 12, and other structures of the same function as the pull-down control module 12 are all within the protection scope of the present disclosure and are not elaborated here.

As illustrated in FIG. 4, the pull-down module 20 comprises of a tenth transistor T10, an eleventh transistor T11, a twelfth transistor T12 and a third capacitor C3.

A gate of the tenth transistor T10 is connected to the first clock signal terminal CK, and a first electrode of the tenth transistor T10 is connected to the first voltage terminal V1, and a second electrode of the tenth transistor T10 is connected to a gate of the twelfth transistor T12.

A gate of the eleventh transistor T11 is connected to the first node A, and a first electrode of the eleventh transistor T11 is connected to the second voltage terminal V2, and a second electrode of the eleventh transistor T11 is connected to the gate of the twelfth transistor T12.

A first electrode of the twelfth transistor T12 is connected to the first voltage terminal V1, and a second electrode of the twelfth transistor T12 is connected to the signal output terminal EO.

A first end of the third capacitor C3 is connected to the second clock signal terminal CB, and a second end of the third capacitor C3 is connected to the gate of the twelfth transistor T12.

It should be noted that the pull-down module 20 may further comprise multiple switching transistors connected in parallel with the tenth transistor T10, and/or multiple switching transistors connected in parallel with the eleventh transistor T11, and/or multiple switching transistors connected in parallel with the twelfth transistor T12. The above are only examples of the pull-down module 20. Other structures of the same function as the pull-down module 20 are all within the protection scope of the present disclosure and are not elaborated here.

As illustrated in FIG. 4, the pull-up module 30 comprises a thirteenth transistor T13.

A gate of the thirteenth transistor T13 is connected to the first node A, and a first electrode of the thirteenth transistor T13 is connected to the second voltage terminal V2, and a second electrode of the thirteenth transistor T13 is connected to the signal output terminal EO.

It should be noted that the pull-up module 30 may further comprise multiple switching transistors connected in parallel with the thirteenth transistor T13. The above are only examples of the pull-up module 30, and other structures of the same function as the pull-up module 30 are all within the protection scope of the present disclosure and are not elaborated here.

Here, it should be noted that, firstly, the types of the transistors in each module or each unit are not limited in the embodiments of the present disclosure, namely, the first transistor T1, the second transistor T2, the third transistor T3, the fourth transistor T4, the fifth transistor T5, the sixth transistor T6, the seventh transistor T7, the eighth transistor T8, the ninth transistor T9, the tenth transistor T10, the eleventh transistor T11, the twelfth transistor T12 and the thirteenth transistor T13 may be of N type transistors or P type transistors. The following embodiments of the present disclosure are described, taking the first transistor T1, the second transistor T2, the third transistor T3, the fourth transistor T4, the fifth transistor T5, the sixth transistor T6, the seventh transistor T7, the eighth transistor T8, the ninth transistor T9, the tenth transistor T10, the eleventh transistor T11, the twelfth transistor T12 and the thirteenth transistor T13 being the P type transistors as an example. Additionally, a transistor in the pixel unit that is connected to the signal output terminal EO of the GOA unit is also implemented by taking the P type transistor as an example.

Wherein, the first electrodes of aforementioned transistors could be the drains, while the second electrodes of aforementioned transistors could be the sources; or, the first electrodes of aforementioned transistors could be the sources, while the second electrodes of aforementioned transistors could be the drains. The embodiments of the present disclosure have no restriction on this.

In addition, the transistors in the above pixel circuit may be classified into enhancement transistors and depletion transistors, based on the different modes of electric conduction. The embodiments of the present disclosure have no restriction on this.

Secondly, all the embodiments of the present disclosure are described, taking inputting high level to the second voltage terminal V2 and inputting low level to or grounding the first voltage terminal V1 as an example. And the "high" and "low" here only represent the relative height relationship between the input voltages.

The following description describes the GOA unit of the present disclosure based on a detailed embodiment.

Figure 5:
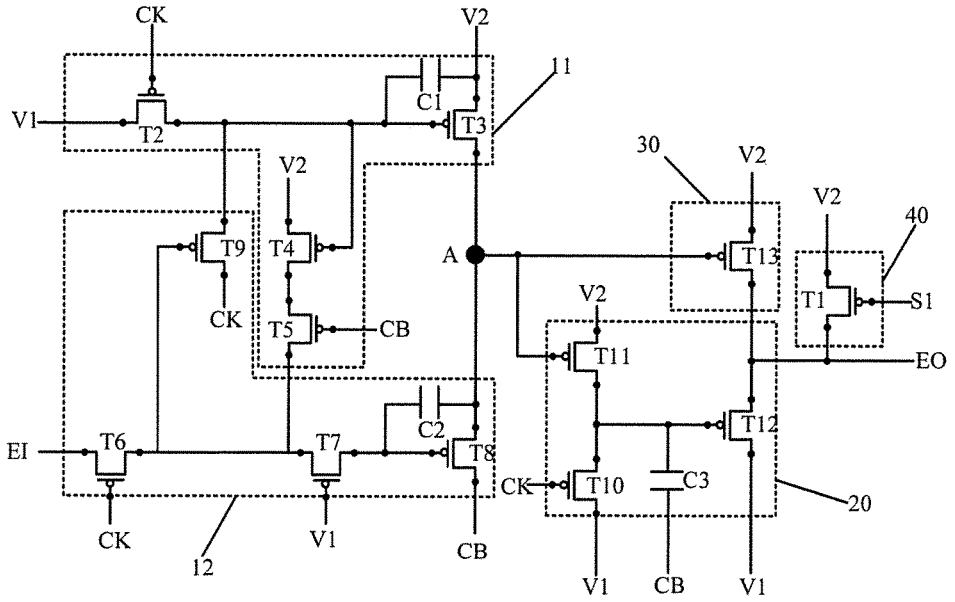
FIG. 5 is a second detailed schematic diagram of all the modules of the GOA unit as shown in FIG. 3.

As illustrated in FIG. 5, a GOA unit of the light emitting control signal is provided. The GOA unit comprises a pull-up control module 11, a pull-down control module 12, a pull-down module 20, a pull-up module 30 and a writing module 40.

In detail, the writing module 40 comprises a first transistor T1.

A gate of the first transistor T1 is connected to the signal control terminal S1, and a first electrode of the first transistor T1 is connected to the second voltage terminal V2, and a second electrode of the first transistor T1 is connected to the signal output terminal EO.

The pull-up control module 11 comprises a second transistor T2, a third transistor T3, a fourth transistor T4, a fifth transistor T5 and a first capacitor C1.

A gate of the second transistor T2 is connected to the first clock signal terminal CK, a first electrode of the second transistor T2 is connected to the first voltage terminal V1, and a second electrode of the second transistor T2 is connected to a gate of the third transistor T3.

A first electrode of the third transistor T3 is connected to the second voltage terminal V2, and a second electrode of the third transistor T3 is connected to the first node A.

A gate of the fourth transistor T4 is connected to the second electrode of the second transistor T2, a first electrode of the fourth transistor T4 is connected to the second voltage terminal V2, and a second electrode of the fourth transistor T4 is connected to a first electrode of the fifth transistor T5.

In the event that the pull-up control module 11 is connected to the second clock signal terminal CB, a gate of the fifth transistor T5 is connected to the second clock signal terminal CB, and a second electrode of the fifth transistor T5 is connected to the pull-down control module 12.

A first end of the first capacitor C1 is connected to the second voltage terminal V2, and a second end of the first capacitor C1 is connected to the gate of the third transistor T3.

The pull-down control module 12 comprises a sixth transistor T6, a seventh transistor T7, a eighth transistor T8, a ninth transistor T9 and a second capacitor C2.

A gate of the sixth transistor T6 is connected to the first clock signal terminal CK, a first electrode of the sixth transistor T6 is connected to the signal input terminal EI, and a second electrode of the sixth transistor T6 is connected to a first electrode of the seventh transistor T7.

A gate of the seventh transistor T7 is connected to the first voltage terminal V1, and a second electrode of the seventh transistor T7 is connected to a gate of the eighth transistor T8.

A first electrode of the eighth transistor T8 is connected to the second clock signal terminal CB, and a second electrode of the eighth transistor T8 is connected to the first node A.

A gate of the ninth transistor T9 is connected to the second electrode of the sixth transistor T6, a first electrode of the ninth transistor T9 is connected to the first clock signal terminal CK, and a second electrode of the ninth transistor T9 is connected to the pull-up control module 11.

A first end of the second capacitor C2 is connected to the second electrode of the seventh transistor T7, and a second end of the second capacitor C2 is connected to the second electrode of the eighth terminal T8.

The pull-down module 20 comprises a tenth transistor T10, an eleventh transistor T11, a twelfth transistor T12 and a third capacitor C3.

A gate of the tenth transistor T10 is connected to the first clock signal terminal CK, a first electrode of the tenth transistor T10 is connected to the first voltage terminal V1, and a second electrode of the tenth transistor T10 is connected to a gate of the twelfth transistor T12.

A gate of the eleventh transistor T11 is connected to the first node A, a first electrode of the eleventh transistor T11 is connected to the second voltage terminal V2, and the second electrode of the eleventh transistor T11 is connected to the gate of the twelfth transistor T12.

A first electrode of the twelfth transistor T12 is connected to the first voltage terminal V1, and a second electrode of the twelfth transistor T12 is connected to the signal output terminal EO.

A first end of the third capacitor C3 is connected to the second clock signal terminal CB, and a second end of the third capacitor C3 is connected to the gate of the twelfth transistor T12.

The pull-up module 30 comprises a thirteenth transistor T13.

A gate of the thirteenth transistor T13 is connected to the first node A, a first electrode of the thirteenth transistor T13 is connected to the second voltage terminal V2, and a second electrode of the thirteenth transistor T13 is connected to the signal output terminal EO.

Figure 6:
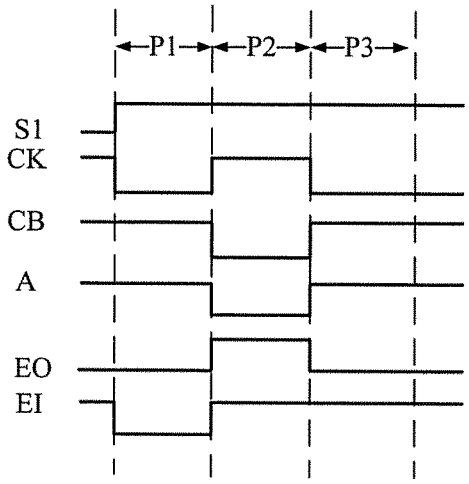
FIG. 6 is a sequence diagram of all signals adopted for driving the GOA unit as illustrated in FIG. 3.

As illustrated in FIG. 6, the display process of each frame of the GOA unit may be divided into a buffer stage P1, a pull-up stage P2 and a pull-down stage P3. It is described in detail below that the work principle of the GOA unit of the light emitting control signal with reference to the time sequence diagram of every control signal terminal as illustrated in FIG. 6.

Figure 7:
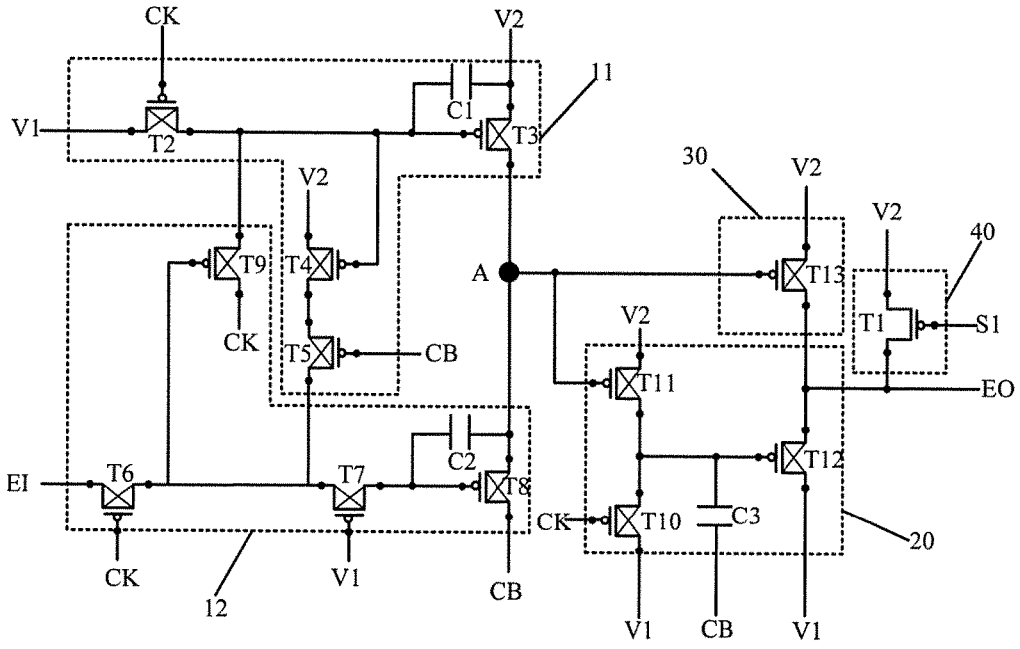
FIGS. 7-10 are equivalent circuit diagrams of the GOA unit as illustrated in FIG. 3 corresponding to different situations.

In the first N image frames, a low voltage signal is input to the signal control terminal S1, and a high voltage signal is input to the first clock signal terminal CK and the second clock signal terminal CB. And at this moment, as illustrated in FIG. 7, the first transistor T1 is turned on, while the second transistor T2, the third transistor T3, the fourth transistor T4, the fifth transistor T5, the sixth transistor T6, the seventh transistor T7, the eighth transistor T8, the ninth transistor T9, the tenth transistor T10, the eleventh transistor T11, the twelfth transistor T12 and the thirteenth transistor T13 are all turned off (the transistors in an off state are indicated by "x").

The first transistor T1 is turned on, and the voltage at the second voltage terminal V2 is written into the signal output terminal EO. The signal output terminal EO is maintained at high voltage and controls the transistor connected thereto to be turned off. At this moment, the other transistors in the GOA unit, affected by the high voltage signal, are all maintained at off state.

Here, N is a positive integer greater than or equal to 1. Optionally in some embodiments of the present disclosure, N=1, namely, in the first image frame, a low voltage signal is input to the signal control terminal S1, and a high voltage signal is input to both the first clock signal terminal CK and the second clock signal terminal CB. At this moment, as illustrated in FIG. 7, the first transistor T1 is turned on, and the voltage of the second voltage terminal V2 is written into the signal output terminal EO. The signal output terminal EO is maintained at high voltage and controls the transistor connected thereto to be turned off.

Figure 8:
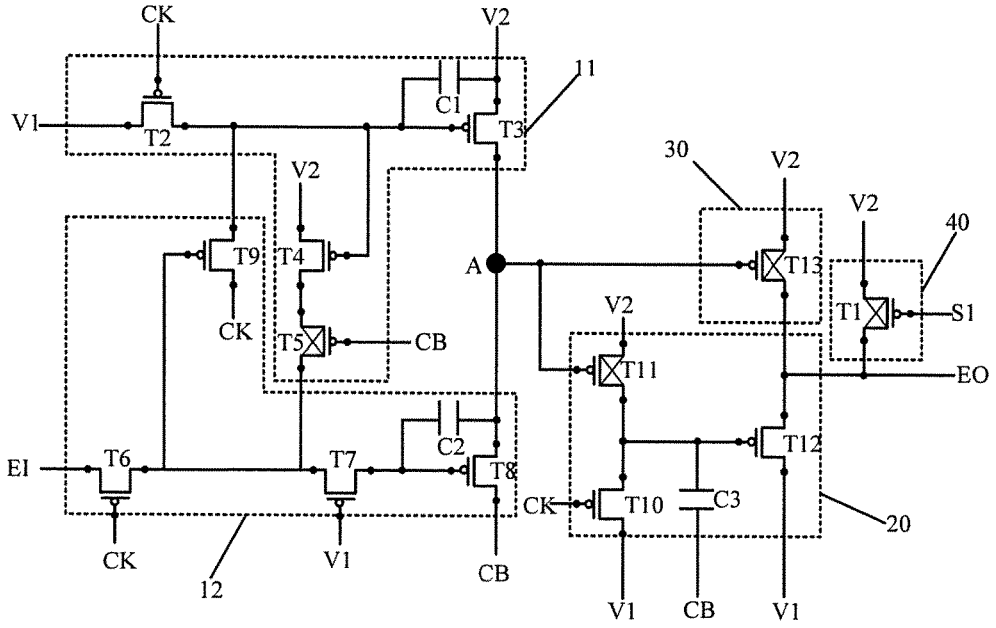

From the $N+1^{th}$ image frame, at the buffer stage P1 of an image frame, a low voltage signal is input to both the first clock signal terminal CK and the signal input terminal EI, a high voltage signal is input to both the second clock signal terminal CB and the signal control terminal S1. At that moment, as illustrated in FIG. 8, the second transistor T2, the third transistor T3, the fourth transistor T4, the sixth transistor T6, the seventh transistor T7, the eighth transistor T8, the ninth transistor T9, the tenth transistor T10 and the twelfth transistor T12 are all turned on, while the first transistor T1, the fifth transistor T5, the eleventh transistor T11 and the thirteenth transistor T13 are all turned off.

As the second transistor T2 is turned on, the signal of the first voltage terminal V1 is written into the gate of the third transistor T3 so as to control the third transistor T3 to be turned on, and meanwhile, the signal of the second voltage terminal V2 is written to the first node A through the third transistor T3. The sixth transistor T6 and the seventh transistor T7 are turned on, the signal of the signal input terminal EI is written into the gate of the eighth transistor through the sixth transistor T6 and the seventh transistor T7, so as to control the eighth transistor T8 to be turned on. And meanwhile the signal of the second clock signal terminal CB is written into the first node A through the eighth transistor T8. The first node A outputs a high voltage signal. At the same time, the low voltage signal from the second electrode of the seventh transistor T7 is written into the first end of the second capacitor C2 to charge the second capacitor C2.

On that basis, the high voltage signal output by the first node A controls the eleventh transistor T11 and the thirteenth transistor T13 to be turned off, and the tenth transistor T10 to be turned on. The signal from the first voltage terminal V1 is written into the gate of the twelfth transistor T12 through the tenth transistor T10, and controls the twelfth transistor T12 to be turned on, so that the voltage at the first voltage terminal V1 is written into the signal output terminal EO through the twelfth transistor T12. The signal output terminal EO outputs a low voltage signal.

Figure 9:
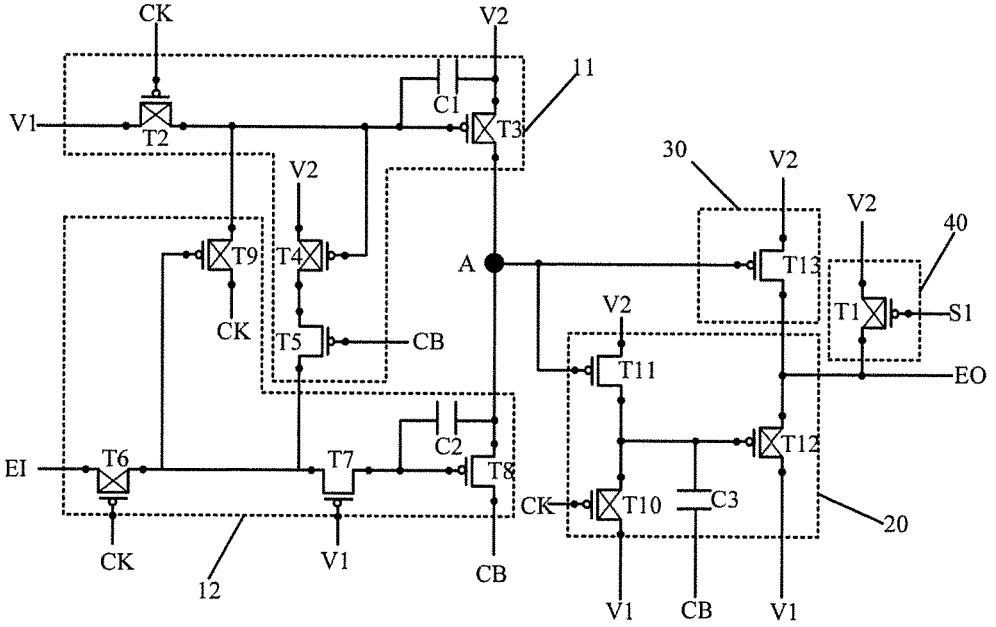

At the pull-up stage P2 of an image frame, a low voltage signal is input to the second clock signal terminal CB, while a high voltage signal is input to the first clock signal terminal CK, the signal control terminal S1 and the signal input terminal EI. Meanwhile, as illustrated in FIG. 9, the fifth transistor T5, the seventh transistor T7, the eighth transistor T8, the eleventh transistor T11 and the thirteenth transistor T13 are all turned on, while the second transistor T2, the third transistor T3, the fourth transistor T4, the sixth transistor T6, the ninth transistor T9, the tenth transistor T10 and the twelfth transistor T12 are all turned off.

The storage capacitor C2 is discharged to control the eighth transistor T8 to be turned on, and the low voltage of the second clock signal terminal CB is written into the first node A. The first node A outputs a low voltage signal.

On this basis, the low voltage of the first node A controls the eleventh transistor T11 and the thirteenth transistor T13 to be turned on. The voltage at the second voltage terminal V2 is written into the gate of the twelfth transistor T12 through the eleventh transistor T11, controlling the twelfth transistor to be turned off. And the voltage at the second voltage terminal V2 is written into the signal output terminal EO through the thirteenth transistor T13. The signal output terminal EO outputs a high voltage signal.

Figure 10:
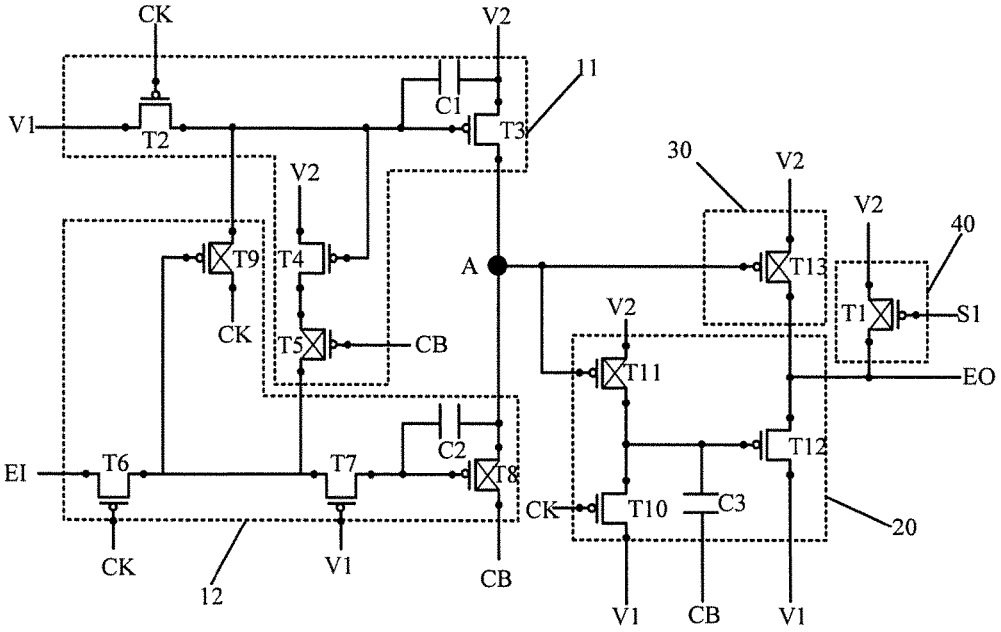

At the pull-down stage P3 of an image frame, a low voltage signal is input to the first clock signal terminal CK, and a high voltage signal is input to the signal input terminal EI, the second clock signal terminal CB and the signal control terminal S1. At this moment, as illustrated in FIG. 10, the second transistor T2, the third transistor T3, the fourth transistor T4, the sixth transistor T6, the seventh transistor T7, the tenth transistor T10 and the twelfth transistor T12 are all turned on, while the first transistor T1, the fifth transistor T5, the eighth transistor T8, the ninth transistor T9, the eleventh transistor T11 and the thirteenth transistor T13 are all turned off.

As the second transistor T2 is turned on, the signal of the first voltage terminal V1 is written into the gate of the third transistor T3 through the second transistor T2 to control the third transistor T3 to be turned on, meanwhile, the signal from the second voltage terminal V2 is written into the first node A through the third transistor T3. The first node A outputs a high level.

On this basis, the high level output by the first node A controls the eleventh transistor T11 and the thirteenth transistor T13 to be turned off and the tenth transistor T10 to be turned on, and the signal from the first voltage terminal V1 is written into the gate of the twelfth transistor T12 through the tenth transistor T10, controlling the twelfth transistor T12 to be turned on and the voltage from the first voltage terminal V1 to be written into the signal output terminal EO through the twelfth transistor T12. The signal output terminal EO outputs a low level.

Figure 1A:
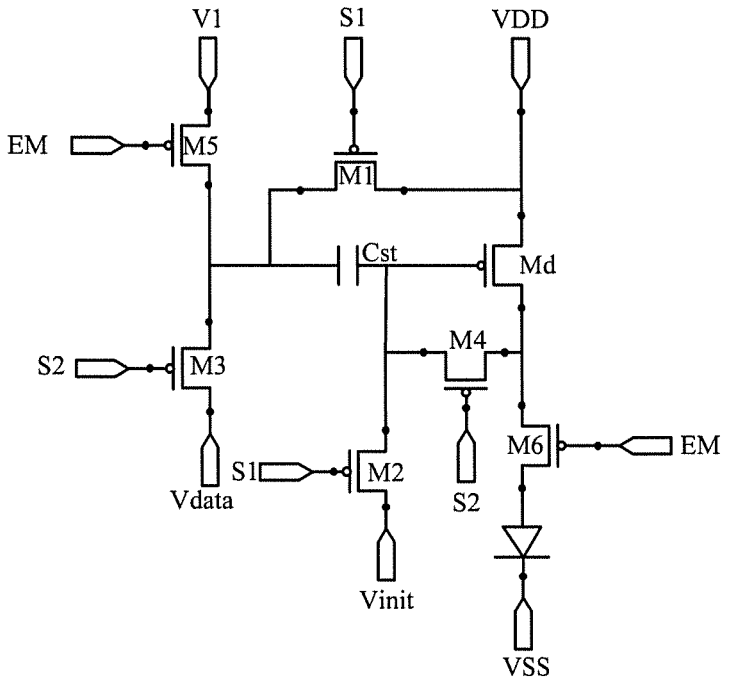
FIG. 1(*a*) is a schematic diagram of a pixel circuit provided by the prior art.
Figure 1B:
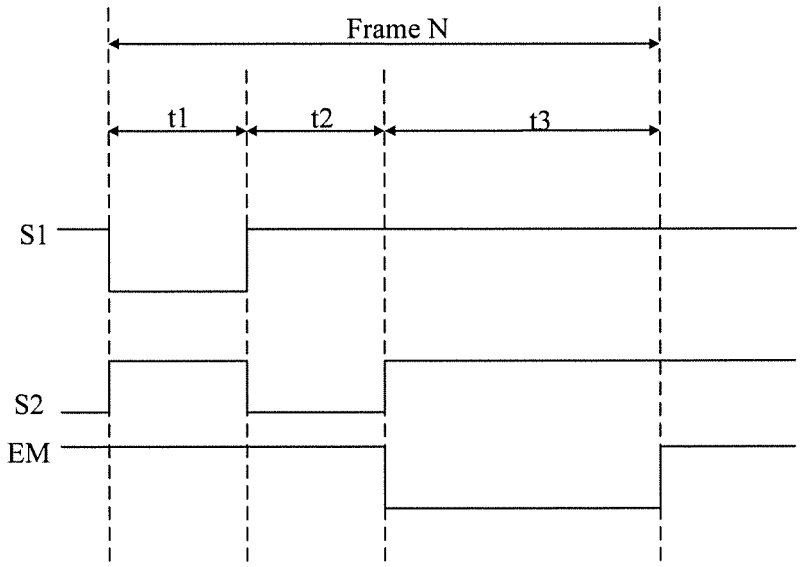

In the pixel circuit as illustrated in FIG. 1 (*a*), a voltage is applied in the sequence of: V1/Vinit on the control signals such as S1/S2/EM on-VDD on-VSS on. Namely, at the resetting stage, a first signal terminal S1 is input with a low voltage turn-on signal, and a enabling signal terminal EM and a scanning signal terminal S2 are input with a high voltage turn-off signal; at the data writing stage, the scanning signal terminal S2 is input with a low voltage turn-on signal, while the first signal terminal S1 and the enabling signal terminal EM are input with a high voltage turn-off signal; at the light emitting stage, the enabling signal terminal EM is input with a low voltage turn-on signal, while the first signal terminal S1 and the scanning signal terminal S2 are input with a high voltage turn-off signal. The signal output from the signal output terminal EO is written into the enabling signal terminal EM to control the sixth transistor M6 to turn on and off and thereby control the light emitting of the pixel circuit.

As illustrated in FIG. 1(*b*), the time periods t1 during which the signal is applied to the first signal terminal S1 and t2 during which the signal is applied to the scanning signal terminal S2 are much shorter than the time period t3 during which the signal is applied to the enabling terminal EM. The reason is that the signals should be applied in turn in a vertical sequence shown in the FIG. 1(*b*), and therefore within the driving time period of t1, horizontal pixels are applied with a control signal, and the next line of pixels are also applied with a control signal in succession, and finally, all the pixels are applied with a control signal in the same manner. So, most of the pixel circuits are applied with a ELVDD voltage from the high voltage terminal VDD during the period of the enabling signal terminal EM being changed to a low voltage (i.e. the light emitting stage); while at the data written stage, the high voltage terminal VDD is applied with a voltage of GND (i.e. 0V-Vth); and at the light emitting stage, the voltage of the high voltage terminal VDD is suddenly changed to the voltage of ELVDD (e.g. 4.5V), thereby enlarging the Vgd of the driving transistor Md (the voltage difference between the Gate and the Drain which decides the voltage difference of the TFT switch), the voltage becoming abnormal. Therefore the current in the driving transistor will become a large current, resulting in an abnormal driving in the pixel circuits, causing a screen flickering in the start-up screen of the display device. Although the ELVDD and ELVSS voltages could be applied before the enabling signal terminal EM turns the low voltage (namely before the GOA circuit connected thereto is driven) to solve the abnormal start-up problem, the whole screen will be brightened up under the circumstance that there is no GOA signal, resulting in an abnormal display screen that a user does not desire to see.

As for the GOA unit provided by some embodiments of the present disclosure, the EM signal is enabled to maintain a high voltage and then the current is prevented from flowing to the light emitting component by controlling the signal output terminal EO to output a high level in the first N frames (several frames where there are abnormal drives in the pixel circuit); from the $N+1^{th}$ frame, the GOA unit is normally driven and a ELVDD voltage and a ELVSS voltage is applied. After the abnormal time period of the first frame, a normal EM driving circuit is used and thereby the screen flickering problem in the pixel circuit is excellently solved.

Figure 11:
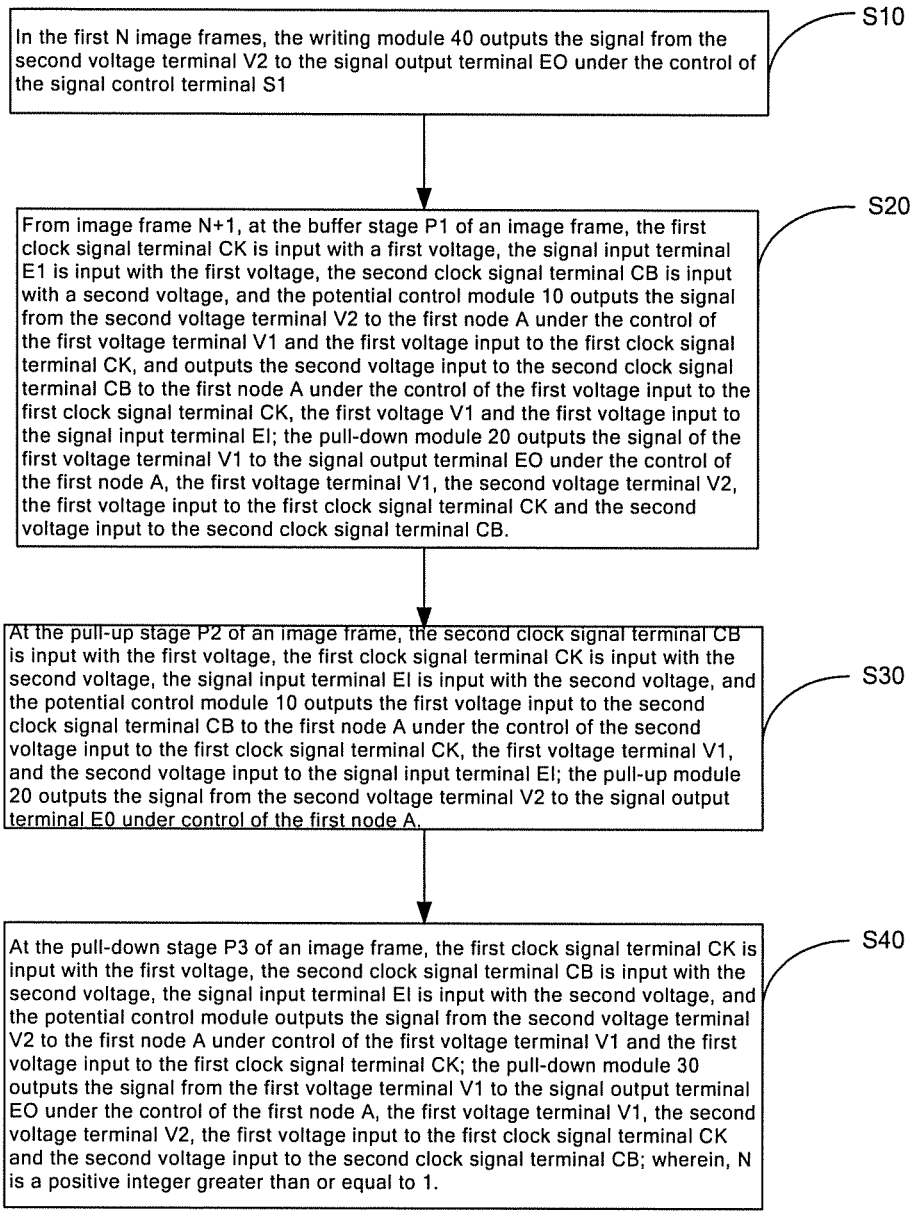
FIG. 11 is a flow chart of a GOA unit driving method provided by the embodiments of the present disclosure.

Some embodiments of the present disclosure also provide a driving method for a GOA unit of the light emitting control signal, as illustrated in FIG. 11, the method comprises the following steps of S10-S40.

S10, in the first N image frames, the writing module 40 writes the signal from the second voltage terminal V2 into the signal output terminal EO under the control of the signal control terminal S1.

Wherein, N is a positive integer greater than or equal to 1.

S20, from the N+1 image frame, at the buffer stage P1 of an image frame, the first clock signal terminal CK is input with a first voltage, the signal input terminal EI is input with the first voltage, the second clock signal terminal CB is input with a second voltage. The potential control module 10 outputs the signal from the second voltage terminal V2 to the first node A under the control of the first voltage terminal V1 and the first voltage input to the clock signal terminal CK, and outputs the second voltage input to the second clock signal terminal CB to the first node A under the control of the first voltage input to the first clock signal terminal CK, the first voltage terminal V1 and the first voltage input to the signal input terminal EI.

The pull-down module 20 outputs the signal from the first voltage terminal V1 to the signal output terminal EO under the control of the first node A, the first voltage terminal V1, the second voltage terminal V2, the first voltage input to the first clock signal terminal CK and the second voltage input to the second clock signal terminal CB.

The first voltage and the second voltage input to each signal terminal are of two relative signal values. For example, the first voltage input to the first clock signal terminal CK is the signal for controlling the transistor to turn on, then the second voltage input to the first clock signal terminal CK is the signal for controlling the transistor to turn off. In detail, the transistor connected to the first clock signal terminal CK is the P type transistor, and then the first voltage input to the first clock signal terminal CK is a low voltage turn-on signal, and the second voltage is a high voltage turn-off signal.

S30, at the pull-up stage P2 of an image frame, the second clock signal terminal CB is input with the first voltage, the first clock signal terminal CK is input with the second voltage, the signal input terminal EI is input with the second voltage, and the potential control module 10 outputs the first voltage input to the second clock signal terminal CB to the first node A under the control of the second voltage input to the first clock signal terminal CK, the first voltage terminal V1, and the second voltage input to the signal input terminal EI.

The pull-up module 30 outputs the signal from the second voltage terminal V2 to the signal output terminal EO under the control of the first node A.

S40, at the pull-down stage P3 of an image frame, the first clock signal terminal CK is input with the first voltage, the second clock signal terminal CB is input with the second voltage, the signal input terminal EI is input with the second voltage, and the potential control module 10 outputs the signal from the second voltage terminal V2 to the first node A under the control of the first voltage terminal V1 and the first voltage input to the first clock signal terminal CK.

The pull-down module 20 outputs the signal from the first voltage terminal V1 to the signal output terminal EO under the control of the first node A, the first voltage terminal V1, the second voltage terminal V2, the first voltage input to the first clock signal terminal CK and the second voltage input to the second clock signal terminal CB.

As for the driving method for a GOA unit of the light emitting control signal provided by some embodiments of the present disclosure, a writing module 40 is added in the GOA unit and is turned on in the first N image frames at the same time of other modules being turned off, and the signal of the second voltage terminal V2 is output to the signal output terminal EO and the light emitting control transistor connected to the signal output terminal EO is controlled to be turned off through the signal output terminal EO. Thus, there is no current flowing to the light emitting component in the pixel circuit no matter the driving transistor is turned on or turned off. And therefore, there will be no incorrect light emitting phenomenon by mistake, and the SSD in the circuit will not cut off the power source. Once the pixel circuit is stabilized, the writing module 40 in the GOA unit is controlled to be turned off, and other modules are controlled to be turned on normally, and then the pixel circuit is controlled to display normally. Therefore, the image quality of the display device can be guaranteed.

Figure 12:
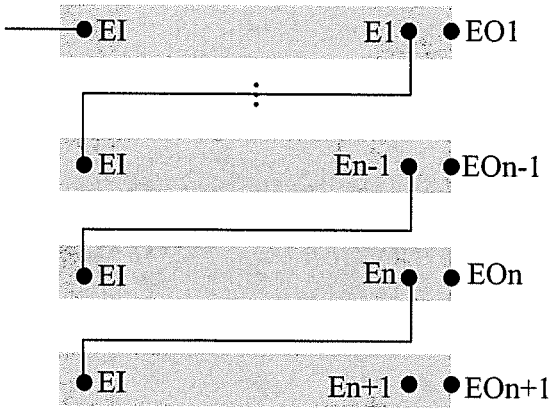
FIG. 12 is a schematic diagram of a GOA circuit provided by the embodiments of the present disclosure.

Some embodiments of the present disclosure provide a GOA circuit. As illustrated in FIG. 12, the GOA circuit comprises multiple cascaded GOA units of the light emitting control signal.

From line 1 to line n+1, the signal input terminal EI is input with a low voltage turn-on signal in turn, while the signal output terminal EO outputs a light emitting control signal in turn.

Additionally, due to each GOA unit is turned on in turn, at the same time, the first clock signal terminal CK and the second clock signal terminal CB in the GOA units of an odd-numbered line present an opposite wave pattern in FIG. 6 with the first clock signal terminal CK and the second clock signal terminal CB in the GOA units of an even-numbered line adjacent to the odd-numbered line.

The GOA circuit provided by some embodiments of the present disclosure has the same beneficial effects as the GOA unit provided by some embodiments of the present disclosure. As the GOA unit has been described with details, no repetition is needed here.

Some embodiments of the present disclosure further provide a display device, comprising the aforementioned GOA circuit.

The display device provided by some embodiments of the present disclosure has the same beneficial effects as the GOA unit provided by some embodiments of the present disclosure. As the GOA unit has been described with details, no repetition is needed here.

It can be understood that the above embodiments are merely illustrative embodiments for the purpose of illustrating the principles of the disclosure, but the disclosure is not limited thereto. It will be apparent to those skilled in the art that various changes and modifications can be made therein without departing from the spirit and essence of the disclosure, which are also considered to be within the scope of the disclosure.

What is claimed is:

1. A GOA unit of a light emitting control signal, comprising a potential control module, a pull-up module, a pull-down module and a writing module;

the potential control module being connected to a first voltage terminal, a second voltage terminal, a first clock signal terminal, a second clock signal terminal, a signal input terminal and a first node, respectively; and being configured to output the signal from the second voltage terminal to the first node under control of the first clock signal terminal and the first voltage terminal; and/or to output the signal from the second clock signal terminal to the first node under control of the first clock signal terminal, the first voltage terminal and the signal input terminal;

the pull-down module being connected to the first node, the first voltage terminal, the second voltage terminal, the first clock signal terminal, the second clock signal terminal and a signal output terminal, respectively; and being configured to output the signal from the first voltage terminal to the signal output terminal under control of the first node, the first voltage terminal, the second voltage terminal, the first clock terminal and the second clock signal terminal;

the pull-up module being connected to the first node, the second voltage terminal and the signal output terminal, respectively; and being configured to output the signal from the second voltage terminal to the signal output terminal under control of the first node;

the writing module being connected to the second voltage terminal, a signal control terminal and the signal output terminal, respectively; and being configured to output the voltage of the second voltage terminal to the signal output terminal under control of the signal control terminal;

wherein, the potential control module comprises a pull-up control module and a pull-down control module;

the pull-up control module is connected to the pull-down control module, the first clock signal terminal, the first voltage terminal, the second voltage terminal and the first node, respectively, and is configured to output the signal from the second voltage terminal to the first node under the control of the first clock signal terminal and the first voltage terminal; and the pull-down control module is connected to the signal input terminal, the first clock signal terminal, the second clock signal terminal, the first voltage terminal and the first node, respectively, and is configured to output the signal from the second clock signal terminal to the first node under the control of the signal input terminal, the first clock signal terminal and the first voltage terminal;

wherein, the pull-down control module comprises a sixth transistor, a seventh transistor, an eighth transistor and a second capacitor;

a gate of the sixth transistor is connected to the first clock signal terminal, a first electrode of the sixth transistor is connected to the signal input terminal, and a second electrode of the sixth transistor is connected to a first electrode of the seventh transistor;

a gate of the seventh transistor is connected to the first voltage terminal, and a second electrode of the seventh transistor is connected to a gate of the eighth transistor;

a first electrode of the eighth transistor is connected to the second clock signal terminal, and a second electrode of the eighth transistor is connected the first node; and a first end of the second capacitor is connected to the gate of the eighth transistor, and a second end of the second capacitor is connected to the second electrode of the eighth transistor.

2. The GOA unit according to claim 1, wherein, the writing module comprises a first transistor;

a gate of the first transistor is connected to the signal control terminal, a first electrode of the first transistor is connected to the second voltage terminal, and a second electrode of the first transistor is connected to the signal output terminal.

3. The GOA unit according to claim 1, wherein, the pull-up control module comprises a second transistor, a third transistor and a first capacitor;

a gate of the second transistor is connected to the first clock signal terminal, a first electrode of the second transistor is connected to the first voltage terminal, and a second electrode of the second transistor is connected to a gate of the third transistor;

a first electrode of the third transistor is connected to the second voltage terminal, a second electrode of the third transistor is connected to the first node;

a first end of the first capacitor is connected to the second voltage terminal, and a second end of the first capacitor is connected to the gate of the third transistor.

4. The GOA unit according to claim 3, wherein, the pull-up control module is further connected to the second clock signal terminal, and the pull-up control module further comprises a fourth transistor and a fifth transistor;

a gate of the fourth transistor is connected to the second electrode of the second transistor, a first electrode of the fourth transistor is connected to the second voltage terminal, and a second electrode of the fourth transistor is connected to a first electrode of the fifth transistor;

a gate of the fifth transistor is connected to the second clock signal terminal, a second electrode of the fifth transistor is connected to the pull-down control module.

5. The GOA unit according to claim 1, wherein, the pull-down control module further comprises a ninth transistor;

a gate of the ninth transistor is connected to the second electrode of the sixth transistor, a first electrode of the ninth transistor is connected to the first clock signal terminal, and a second electrode of the ninth transistor is connected to the pull-up control module.

6. The GOA unit according to claim 1, wherein, the pull-down module comprises a tenth transistor, an eleventh transistor, a twelfth transistor and a third capacitor;

a gate of the tenth transistor is connected to the first clock signal terminal, a first electrode of the tenth transistor is connected to the first voltage terminal, and a second electrode of the tenth transistor is connected to a gate of the twelfth transistor;

a gate of the eleventh transistor is connected to the first node, a first electrode of the eleventh transistor is connected to the second voltage terminal, and a second electrode of the eleventh transistor is connected to the gate of the twelfth transistor;

a first electrode of the twelfth transistor is connected to the first voltage terminal, and a second electrode of the twelfth transistor is connected to the signal output terminal;

a first end of the third capacitor is connected to the second clock signal terminal, and a second end of the third capacitor is connected to the gate of the twelfth transistor.

7. The GOA unit according to claim 1, wherein, the pull-up module comprises a thirteenth transistor;

a gate of the thirteenth transistor is connected to the first node, a first electrode of the thirteenth transistor is connected to the second voltage terminal, and a second electrode of the thirteenth transistor is connected to the signal output terminal.

8. A driving method for a GOA unit of the light emitting control signal according to claim 1, comprising:

within the first N image frames, the writing module writes the signal from the second voltage terminal to the signal output terminal under control of the signal control terminal;

from the image frame N+1, at the buffer stage of an image frame, the first clock signal terminal is input with a first voltage, the signal input terminal is input with the first voltage, the second clock signal is input with a second voltage; and the potential control module outputs the signal from the second voltage terminal to the first node under the control of the first voltage terminal and the first voltage input to the first clock signal terminal, and outputs the second voltage input to the second clock signal terminal to the first node under the control of the first voltage input to the first clock signal terminal, the first voltage terminal and the first voltage input to the signal input terminal;

the pull-down module outputs the signal from the first voltage terminal to the signal output terminal under control of the first node, the first voltage terminal, the second voltage terminal, the first voltage input to the first clock signal terminal and the second voltage input to the second clock signal terminal;

at the pull-up stage of an image frame, the second clock signal terminal is input with the first voltage, the first clock signal terminal is input with the second voltage, the signal input terminal is input with the second voltage; and the potential control module outputs the first voltage input to the second clock signal terminal to the first node under the control of the second voltage input to the first clock signal terminal, the first voltage terminal and the second voltage input to the signal input terminal;

the pull-up module outputs the signal of the second voltage terminal to the signal output terminal under the control of the first node;

at the pull-down stage of an image frame, the first clock signal terminal is input with the first voltage, the second clock signal terminal is input with the second voltage, the signal input terminal is input with the second terminal, and the potential control module outputs the signal from the second voltage terminal to the first node under control of the first voltage terminal and the first voltage input to the first clock signal terminal;

the pull-down module outputs the signal from the first voltage terminal to the signal output terminal under control of the first node, the first voltage terminal, the second voltage terminal, the first voltage input to the first clock signal terminal and the second voltage input to the second clock signal terminal;

wherein, N is a positive integer greater than or equal to 1.

9. A GOA circuit, comprising multiple cascaded GOA units of the light emitting control signal according to claim 1.

10. A display device, comprising the GOA circuit according to claim 9.

* * * * *